US005584158A

United States Patent [19]

Johnson

[11] Patent Number: 5,584,158

[45] Date of Patent: Dec. 17, 1996

[54] ARCHITECTURAL SUPPORT

[76] Inventor: Eric S. Johnson, P.O. Box 981041, Houston, Tex. 77098

[21] Appl. No.: 542,523

[22] Filed: Oct. 13, 1995

[51] Int. Cl.[6] ..... E04B 1/343; E04C 3/00; E04C 3/30

[52] U.S. Cl. ..... 52/720.2; 52/127.1; 52/632; 52/645; 52/726.3; 52/736.2; 52/736.4; 52/737.5; 52/739.1; 312/351; 403/218

[58] Field of Search ..... 52/633, 645, 632, 52/127.1, 720.2, 736.2, 736.3, 737.4, 737.5, 739.1, 726.3, 736.4; 312/351

[56] References Cited

U.S. PATENT DOCUMENTS

| | | | |
|---|---|---|---|
| Re. 26,105 | 11/1966 | Guillon et al. | 312/351.3 |
| 183,921 | 10/1876 | Haas | 52/726.3 X |
| 460,826 | 10/1891 | Knause | 52/726.3 X |
| 2,143,567 | 1/1939 | Mueller | 52/739.1 X |
| 3,200,554 | 8/1965 | Goodman et al. | 52/720.2 |
| 3,437,059 | 4/1969 | Stonier et al. | 52/726.3 X |
| 4,035,978 | 7/1977 | Bajorek et al. | 52/720.2 |
| 4,641,467 | 2/1987 | Dupuis, Jr. | 52/726.3 X |
| 5,035,401 | 7/1991 | Solter | 52/720.2 X |
| 5,474,501 | 12/1995 | Teng | 52/726.3 X |

*Primary Examiner*—Christopher T. Kent
*Attorney, Agent, or Firm*—Gunn & Associates, P.C.

[57] ABSTRACT

An architectural support comprised of various splines, key ways, and collars which interlock and when assembled form a complete unit. This unit may be used as an architectural support in the construction or fabrication of a table, display, cabinet, stand, and platform. This architectural support in the above items would be used as a table leg, support leg, or door pull. In addition, the architectural support could be used for decorative or aesthetic purposes.

10 Claims, 4 Drawing Sheets

ARCHITECTURAL SUPPORT

BACKGROUND OF THE INVENTION

1) Field of Invention

The present invention relates to the structural support of architectural stands and pieces such as tables, display stands, door pulls, displays, and the like.

2) Description of Prior Art

As far as known, there appears to be no prior art patent dealing with an assembly in which splines or keys interlock with collars about a centralized bar, such assembly being used as an architectural support such as a table leg or platform leg or door pull.

SUMMARY OF INVENTION

The present invention provides a new and improved structural support that can be used with a great deal of variety in the application of table legs, architectural stands, displays, and door pulls.

This particular support's unique innovation is due to the fact that it is composed of individual splines, keys, collars, and pieces that interlock to form a single support. The interlocking aspects provide flexibility in various materials and colors while providing an easily assembled support. In addition, the individual components when assembled to form the invention form a very strong structural support.

This architectural support would be mounted in various fashions to round rings, square rings, rings of various configuration, enclosures, displays, cabinets, and the like for the purpose of making tables, stands, displays, and the like. In addition, it may be attached to doors and entry systems as a pull or opener. This support could be used as a single unit or multiple units in the above configurations.

DESCRIPTION OF THE EMBODIMENT

Figure 1:
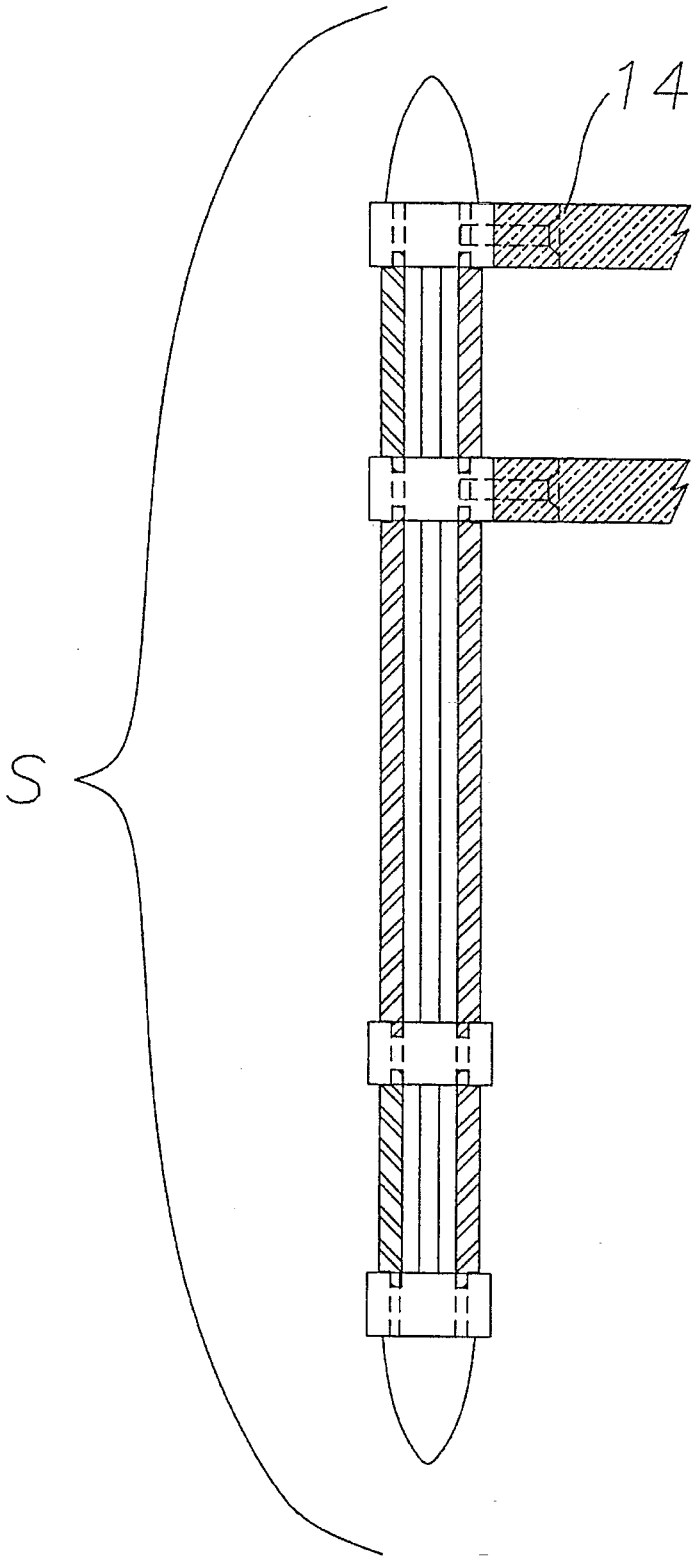
FIG. 1 is a two-dimensional view of the architectural support.
Figure 2A:
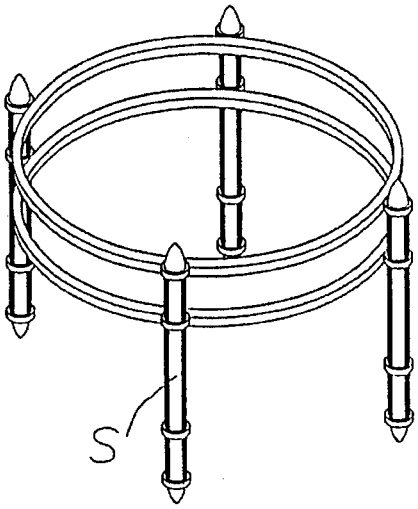
FIG. 2 is three applications of the architectural support.
Figure 2B:
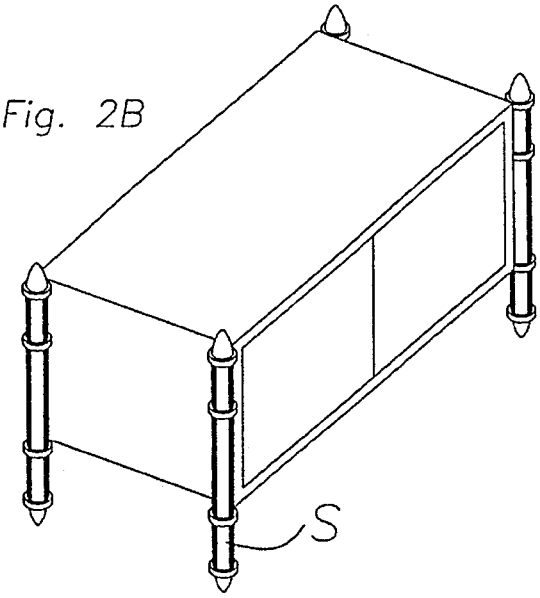
Figure 2C:
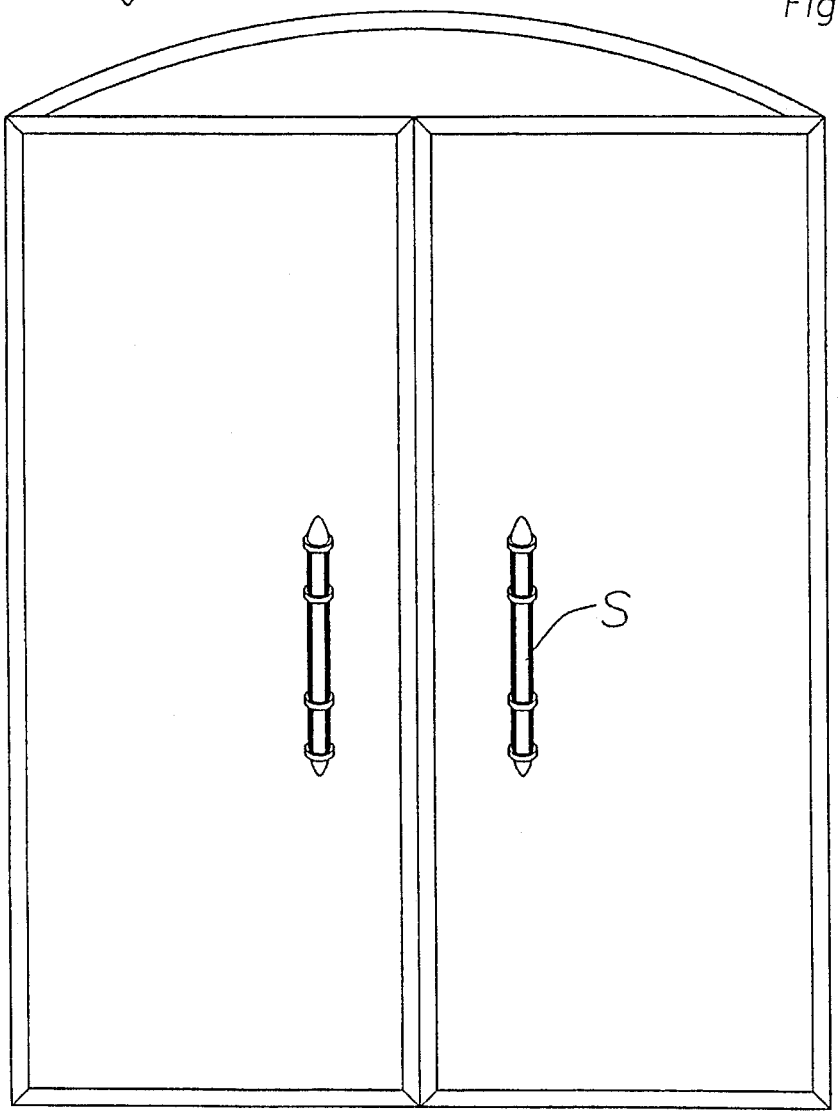

In the drawings, the letter S designates generally a new and improved architectural support according to the present invention. The architectural support S (FIG. 1) may be of the type used in the assembly of a table, S-1 (FIG. 2), or in the assembly of a display or cabinet, S-2 (FIG. 2), and in the use as a door pull, S-3 (FIG. 2).

Figure 3:
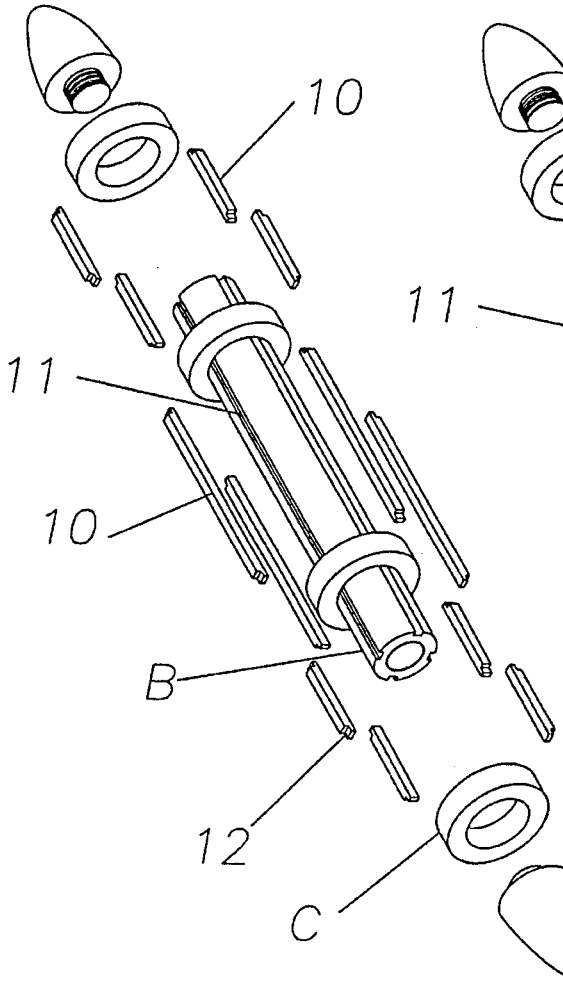
FIG. 3 is an isometric view of all the components of the architectural assembly.
Figure 4:
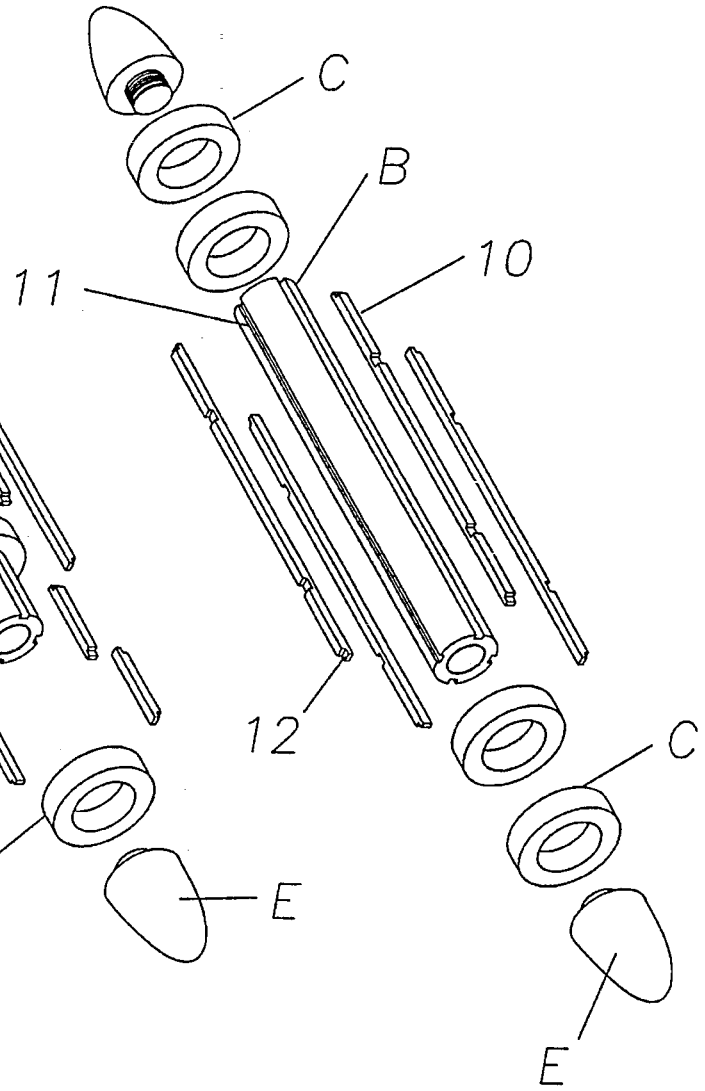
FIG. 4 is an isometric view of all the components of the architectural assembly.

The architectural support S consists of a centralized bar B with slots 11 or key ways 11 milled or formed at a given space or spaces apart on the outside diameter or surface (FIG. 3 and FIG. 4). In addition, spline 10, key stock 10, or square bar 10 or bar of the same profile as the slots 11 on bar B are notched at both ends 12 FIG. 3 or, as an alternate method, notched as in FIG. 4. FIG. 4 shows the bar stock 10 as one continuous piece, as opposed to FIG. 3 where the bar stock 10 would be in separate pieces. Both methods achieve the same results.

Figure 5:
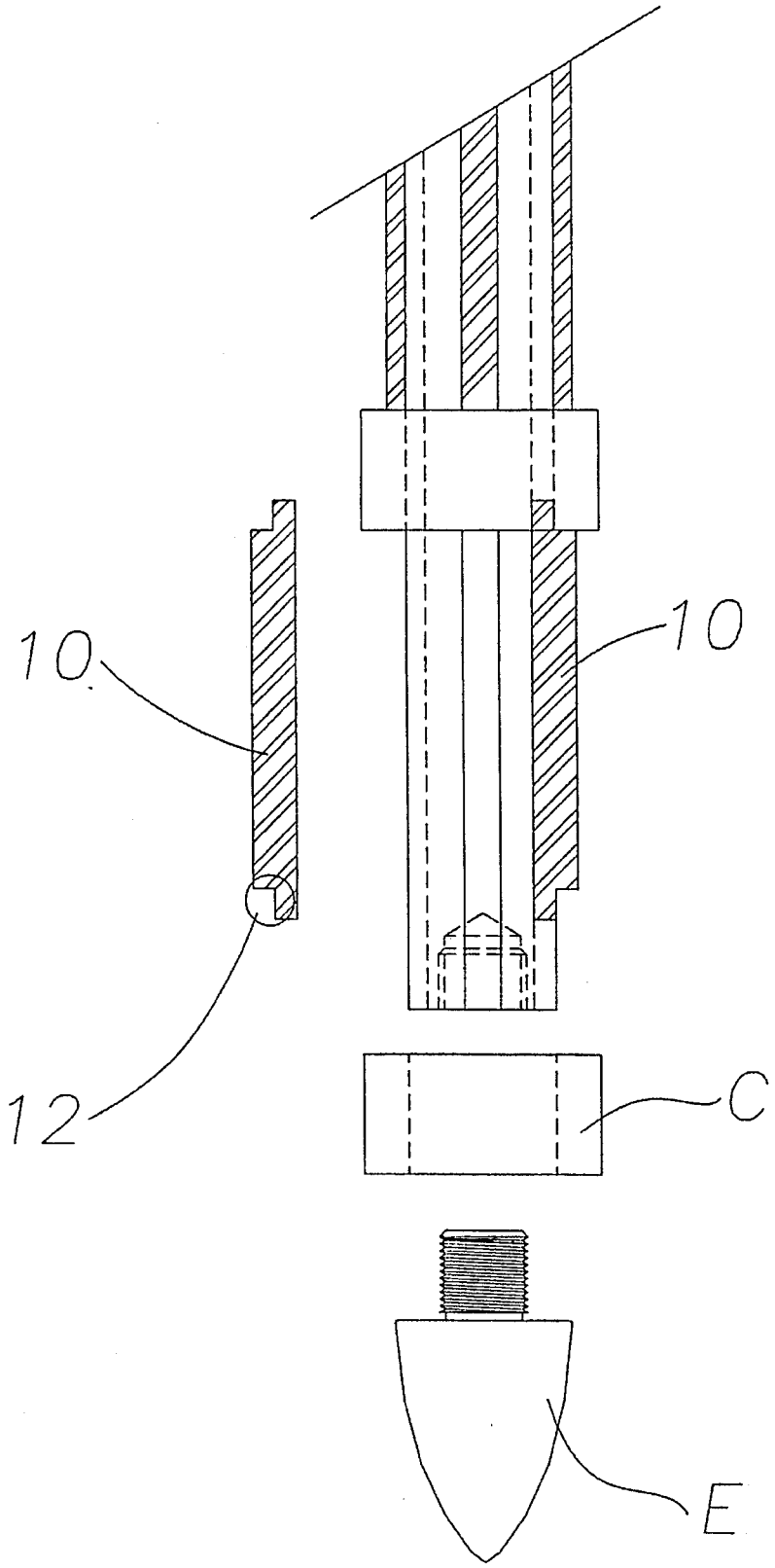
FIG. 5 is a diagram of the interlocking mechanism of the components of the architectural support.

The bar stock 10 or splines 10 or key stock 10 is held in place on the bar B slots 11 by a collar C with a hole through the center which slides over the notch 12 on each spline 10 or key 10 (FIG. 3, FIG. 4, FIG. 5).

The collar C and the whole assembly is kept in place by the threaded end cap E when screwed in each end of bar B. This end cap E holds the complete assembly in place. FIG. 5.

The complete assembly or architectural support can then be attached to a ring, enclosure, display, or any structure by the following but not limited to these methods 14: bolts, screws, pins, and welding. FIG. 1 & FIG. 2.

In the operation of the present invention, the interlocking part assembly gives a tremendous number of color, material and part design combinations while increasing the strength of the structural support.

The foregoing disclosure and description of the invention are illustrative and explanatory, thereof, and various changes in the size, shape, materials, components, connections and contacts as well as details of the illustrated construction and method of operation and assembly may be made without departing from the spirit of the inventor.

I claim:

1. An architectural support comprising:

an elongate central bar;

an axially oriented key way in the central bar;

a key adapted to fit within the key way, the key defining a notch at at least one end thereof, the notch extending radially from the central bar;

a collar adapted to fit around the central bar and in abutting contact with the notch in the key; and an end cap at an end of the central bar to retain the collar in abutting contact with the notch in the key.

2. The architectural support of claim 1 further comprising a mounting member joined to the collar to mount the architectural support to a piece of furniture.

3. The architectural support of claim 1 further comprising a mounting member joined to the collar to mount the architectural support to an architectural structure.

4. The architectural support of claim 1 wherein the central bar defines a circular cross section.

5. The architectural support of claim 1 further comprising a plurality of axially oriented key ways in the central bar and a key adapted to fit within each of the plurality of key ways.

6. A support comprising:

an elongate, axially oriented central bar having a key-way parallel to the axis of the central bar;

a key adapted to fit within the key-way, the key having a first end and a second end and having a notch at each end thereof extending radially from the central bar;

a collar adapted to fit around the central bar and in abutting contact with one of said notches in the key to retain the key within the bar; and an end cap proximate an end of the central bar to retain the collar in abutting contact with the notch in the key.

7. The support of claim 6 further comprising a mounting member joined to the collar to mount the support to a piece of furniture.

8. The architectural support of claim 6 where in the central bar defines a circular cross section.

9. The architectural support of claim 6 further comprising a plurality of key-ways parallel to the axis of the central bar and a key adapted to fit within each of the plurality of key ways.

10. The architectural support of claim 6 further comprising a mounting member joined to the collar to mount the architectural support to an architectural structure.

* * * * *